US010232639B2

(12) United States Patent
Feygelman et al.

(10) Patent No.: US 10,232,639 B2
(45) Date of Patent: Mar. 19, 2019

(54) FLUID APPLICATION

(71) Applicant: HP INDIGO B.V., Amstelveen (NL)

(72) Inventors: Alex Feygelman, Petach-Tiqwa (IL); Boaz Tagansky, Rishon Letzion (IL); Gil Fisher, Shoham (IL); Mordechai Arenson, Rehovot (IL); Roy Maman, Ness Ziona (IL)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 15/545,955

(22) PCT Filed: Apr. 14, 2015

(86) PCT No.: PCT/EP2015/058019

§ 371 (c)(1),
(2) Date: Jul. 24, 2017

(87) PCT Pub. No.: WO2016/165740

PCT Pub. Date: Oct. 20, 2016

(65) Prior Publication Data

US 2018/0009239 A1 Jan. 11, 2018

(51) Int. Cl.
*B41J 11/00* (2006.01)
*B41J 25/00* (2006.01)

(52) U.S. Cl.
CPC ..... *B41J 11/0015* (2013.01); *B41J 11/0025* (2013.01); *B41J 25/001* (2013.01)

(58) Field of Classification Search
CPC ... B41J 2/005; B41J 2/0057; B41J 2/22; B41J 2/2114; B41J 2/2117; B41J 11/0015; B41J 2002/012
See application file for complete search history.

(56) References Cited

U.S. PATENT DOCUMENTS

| | | | | |
|---|---|---|---|---|
| 3,717,722 | A * | 2/1973 | Messner | D06B 11/0059 118/624 |
| 5,044,307 | A | 9/1991 | Takahashi et al. | |
| 6,935,734 | B2 | 8/2005 | Askren et al. | |
| 2005/0039273 | A1 | 2/2005 | Hawley et al. | |

(Continued)

FOREIGN PATENT DOCUMENTS

| | | |
|---|---|---|
| CN | 1756604 | 4/2006 |
| CN | 1826180 | 8/2006 |

(Continued)

OTHER PUBLICATIONS

Unknown, "Semi-Rotary Flexographic Printing Station", digicon range, abg International, May 21, 2014, 4 pages.

*Primary Examiner* — Geoffrey S Mruk
*Assistant Examiner* — Scott A Richmond
(74) *Attorney, Agent, or Firm* — HP Inc. Patent Department

(57) ABSTRACT

Certain examples of apparatus for applying fluid in a printing system are described. The apparatus comprise a first chamber having a first aperture extending along a first axis, and a second chamber having a second aperture extending along a second axis, wherein the first axis is substantially parallel to the second axis. The second chamber is movable with respect to the first chamber. Also, methods for supplying a fluid, and printing systems are described.

16 Claims, 11 Drawing Sheets

(56) References Cited

U.S. PATENT DOCUMENTS

| | | | | |
|---|---|---|---|---|
| 2006/0035033 | A1* | 2/2006 | Tanahashi | B05B 13/0207 427/421.1 |
| 2009/0002412 | A1* | 1/2009 | Kawakami | B41J 2/155 347/8 |
| 2015/0283829 | A1* | 10/2015 | Gazit | B41F 23/08 347/9 |

FOREIGN PATENT DOCUMENTS

| | | |
|---|---|---|
| EP | 2014376 | 1/2009 |
| EP | 2055832 | 5/2009 |
| EP | 1841918 | 5/2013 |
| JP | H05200346 | 8/1993 |
| JP | 2002066420 | 3/2002 |
| JP | 2007125463 | 5/2007 |
| JP | 2014097452 | 5/2014 |
| WO | WO-2008040851 | 4/2008 |

* cited by examiner

FLUID APPLICATION

BACKGROUND

Some printing technologies employ a special substrate coating or a priming treatment prior to the application of ink or toner. Generally this kind of treatment is performed at a stage when a print medium or substrate is fed from a roll, e.g. before cutting operations. Applying a priming treatment in this manner helps the treatment process to be stable and continuous. However, there are cases when a priming treatment is better applied to cut sheets of print media or substrate. For example, this may be the case for thick substrates or for cases where a priming fluid is applied shortly before ink application for better ink adhesion. There are also cases where a print medium or substrate or other print target may vary in shape and/or size. For example, in a printing system with a variable cut sheet size, a substrate coating may be applied to varying sizes of sheet.

BRIEF DESCRIPTION OF THE DRAWINGS

Some non-limiting examples of the present disclosure will be described in the following with reference to the appended drawings, in which.

DETAILED DESCRIPTION

Certain examples as described herein provide an apparatus for use in a printing system or in combination with a printing system. In particular, certain examples enable the application of a fluid to substrates of varying sizes. In one case, an apparatus is provided that enables a fluid to be applied to substrates of varying widths. In this case, an apparatus for applying a fluid may comprise a first chamber arranged to receive the fluid and having a first housing and a first elongate aperture through which fluid may be discharged. The apparatus may further have a second chamber arranged to receive the fluid and having a housing and a second elongate aperture through which the fluid may be discharged. The first and second apertures may be arranged substantially parallel to each other, and the second chamber may be arranged to be movable with respect to the first chamber. By changing the position of the second chamber with respect to the first chamber, the position of the second aperture is changed with respect to the first aperture. By suitably positioning the two apertures, the width over which fluid is supplied may be adapted. The fluid may be applied to a transfer member, which further supplies the fluid to a print medium or print target. Alternatively, the fluid may be applied to a substrate or print target directly.

Figure 1A:
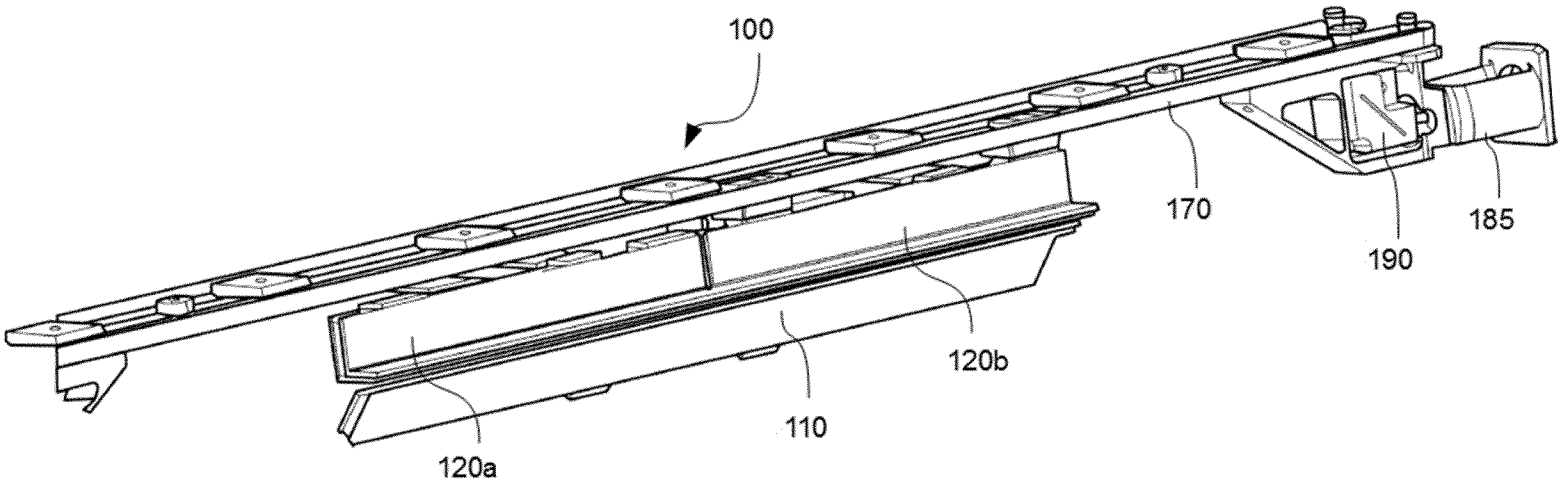
FIG. 1A is a schematic drawing showing a perspective view of an apparatus for applying a fluid to a print medium in a printing system according to an example.

FIG. 1A shows a perspective view of an apparatus 100 according to an example. The apparatus 100 in this example comprises a first chamber 110. The chamber 110 is arranged to receive a fluid. This fluid may comprise a priming fluid or substrate coating, e.g. a fluid suitable for application in a printing process. It may comprise a fluid for pre or post treatment of an item, e.g. a primer or varnish. In certain cases the fluid is a liquid. In FIG. 1A, the chamber 110 is substantially closed but comprises an elongated aperture or slit through which the fluid may exit, as further explained below.

Priming fluids and other fluids can have an aggressive nature, e.g. they can have a low pH or a high pH. Additionally, fluids in apparatus such as printing apparatus can be damaging in other ways, for example when they dry up or when they are supplied in too large amounts. Appropriate control of the application of such fluids and sealing can thus improve the functionality or performance of such apparatus.

In FIG. 1A, the apparatus further comprises a second chamber 120A and a third chamber 120B, whereas the first chamber 110 is fixed or static. The second and third chambers in this example are arranged to be movable. The fixed chamber may receive the fluid through inlet nozzle 140B and the movable chamber similarly has an inlet nozzle 140A. As may be seen in FIG. 1C, both the fixed chamber and movable chambers have an elongate aperture 116 and 126 respectively through which fluids may exit the chamber and reach a transfer member, in this case the anilox roller 200.

Figure 1B:
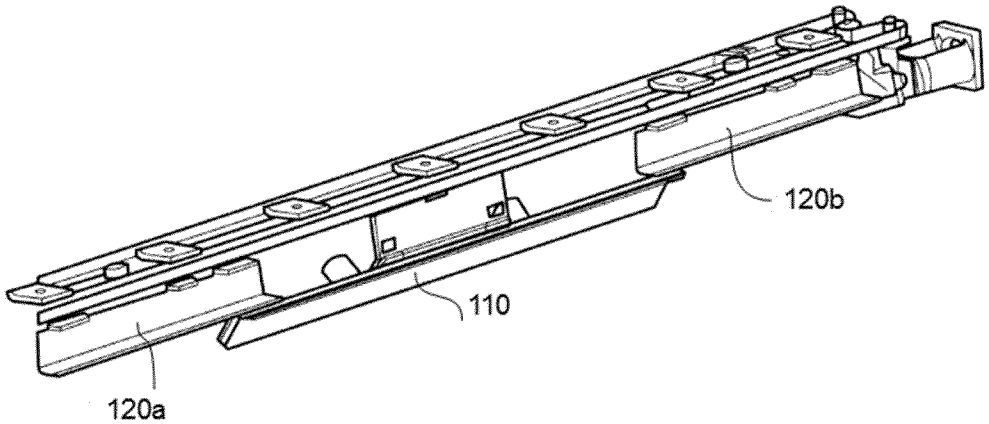
FIG. 1B is a schematic drawing showing a perspective view of part of the apparatus of FIG. 1*a* in a position adapted to a different print medium according to an example.
Figure 1C:
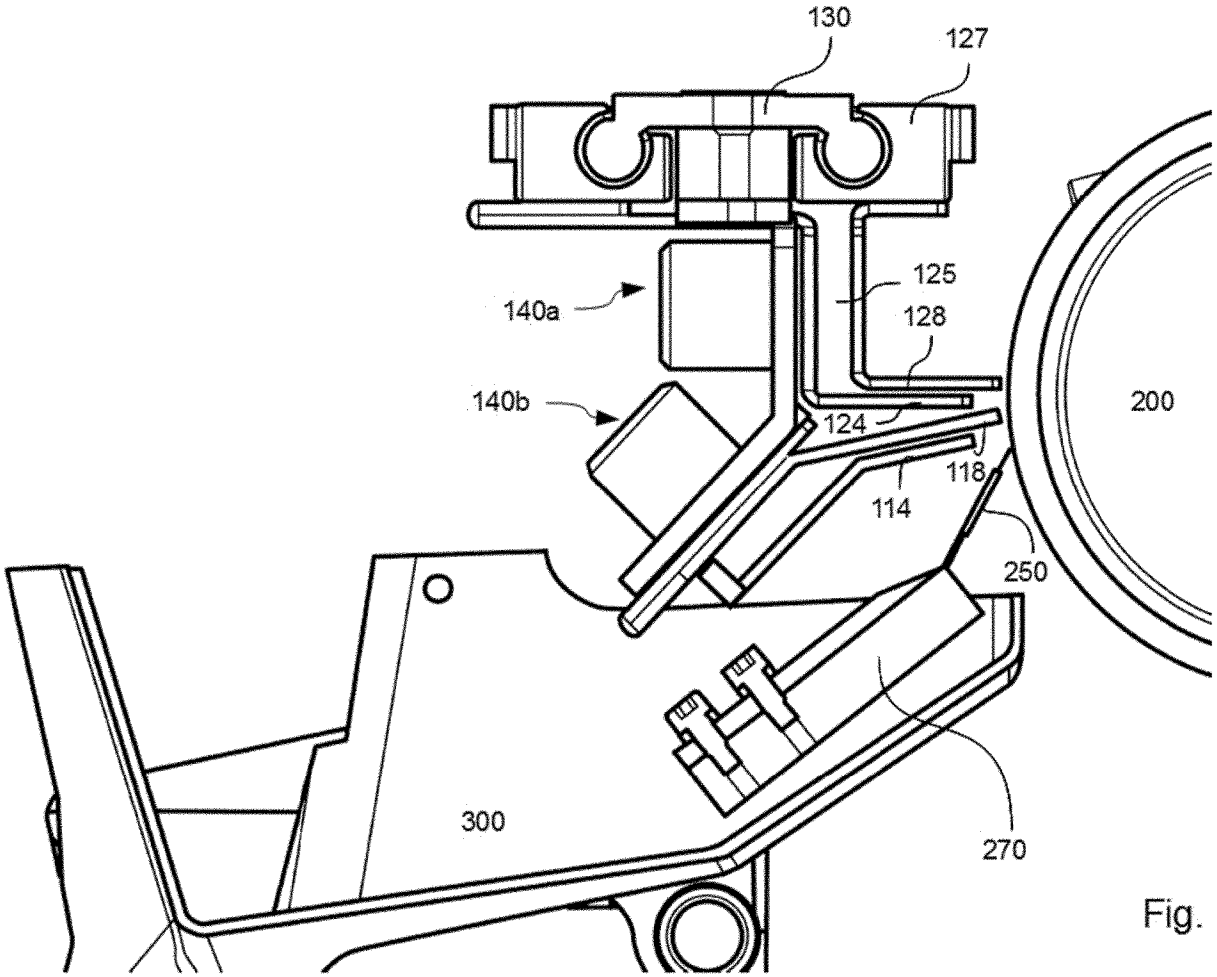
FIG. 1C is a schematic drawing showing a cross-section along an axis of the apparatus of FIG. 1*a* according to an example.

As can be seen in FIG. 1C, the aperture of the first fixed chamber in this example is formed between a lower projection 114 and an upper projection 118. Similarly, the aperture of the movable chamber is formed between a lower projection 124 and an upper projection 128. The upper projections 118 and 128 of the fixed chamber and movable chamber respectively extend towards the surface of the anilox roller 200. The fluid from the chambers attaches to the projections 118 and 128 as it flows on towards the anilox roller. As can be seen in FIG. 1C, the projections 118 and 128 do not contact the surface of the anilox roller 200 in this example.

In one example, fluid is supplied to the supply nozzles 140A and 140B during use. The fixed and movable chambers may thus be pressurized. In this case the majority of the pressure drop in the apparatus is across the aperture region. This allows laminar fluid flow from the aperture.

Also shown in FIG. 1C is a doctor blade 250 that is arranged to remove any surplus of fluid on the anilox roller. The doctor blade 250 is held in blade support 270. The surplus of fluid removed from the anilox roller 200 flows over the doctor blade 250 to a collection tray 300. The fluid collected in the collector tray 300 may be recirculated in the fluid supply system and thus ultimately be re-supplied to the anilox roller. A doctor blade may be a thin elongate member that substantially extends along the length of the anilox roller and an area of the doctor blade may be in fluid communication with a fluid tank, e.g. via the collection tray 300.

In the shown example, the movable chambers are attached to a slide 170. The slide is arranged to be movable along guide 130. Guide 130 in this example comprises two parallel bars 135A and 135B. The slide 170 has recesses along its top surface and the shape of the recesses is complementary to the shape of bars 135A and 135B. Reference may be had particularly to FIGS. 1C and 1D. Suitable friction reducing material or coating may be provided for either the bars 135A and 135B or the slide 170, or both. With a drive mechanism, the slide 170 may be moved along the bars to change the position of the movable chamber with respect to the fixed chamber. Details of an example of such a drive mechanism will be explained in more detail with reference to other figures.

Figure 1D:
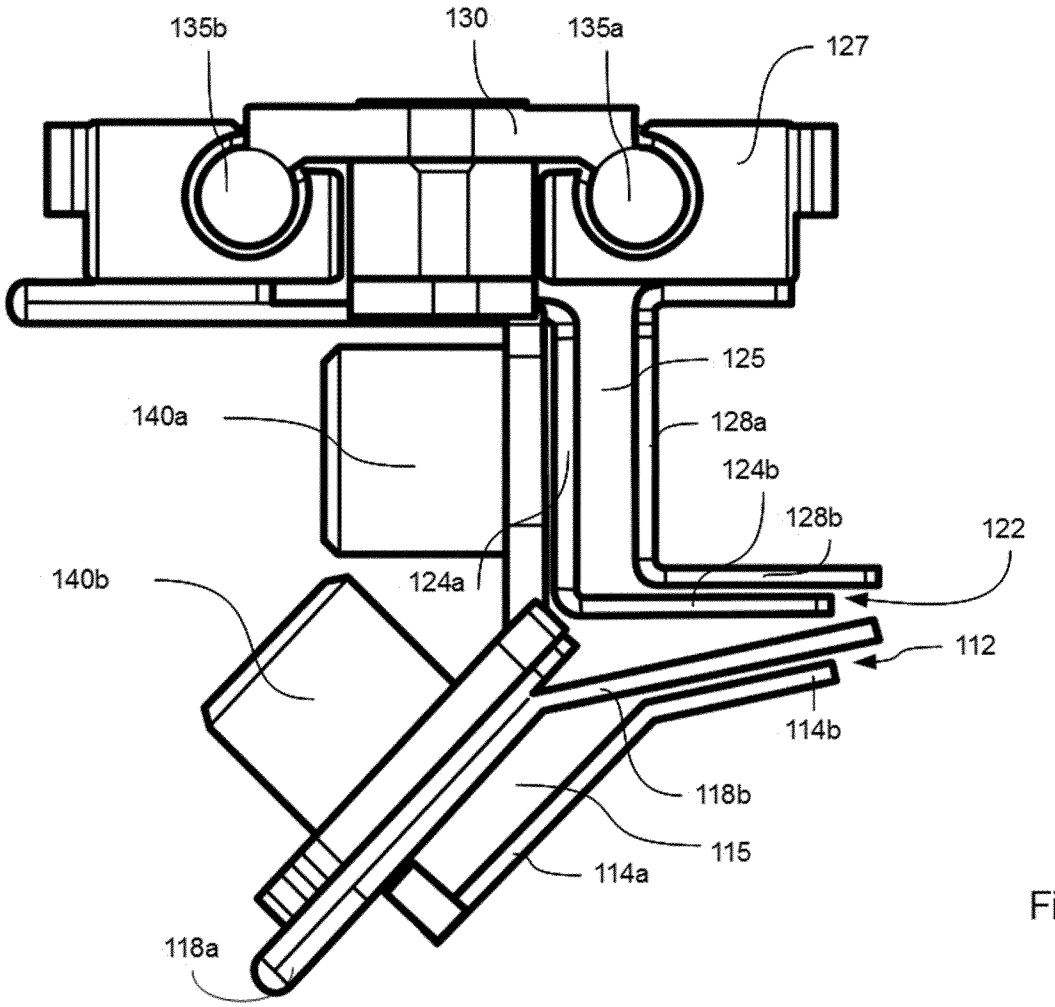
FIG. 1D is a schematic drawing showing an enlarged view of the cross-section shown in FIG. 1C.

Some more details of the movable chamber 120 and fixed chamber 110 may be illustrated with reference to FIG. 1D. The static or fixed chamber 110 in this example may have a housing comprising a rear bracket 118, and a front bracket 114. The sides of the housing may be suitably closed and sealed. The volume 115 in between the rear bracket 118 and front bracket 114 may be filled with the fluid to be supplied. The rear bracket 118 herein includes a rear wall 118*a* and a forward projection 118*b*. Similarly, the front bracket herein includes a front wall 114*a* and a forward projection 114*b*. A first aperture is formed between the forward projections 114*b* and 118*b*.

Similar, the movable chamber may have a housing comprising a rear bracket 124, and a front bracket 128. The rear bracket herein has a rear wall 124*a* and a forward projection 124*b*. An aperture is formed between the forward projections 124*b* and 128*b*. The volume 125 in between the rear bracket 124 and front bracket 128 may be filled with the fluid to be supplied.

The fluid chambers may thus be relatively easily manufactured. The brackets may be made of e.g. a stainless steel or another material suitable for withstanding e.g. low or high pH fluids in the case of primer fluids.

FIGS. 1A and 1B show the same fluid supply system, wherein however the position of the movable second chamber 120A and movable third chamber 120B is different. In FIG. 1A, the movable chambers 120A and 120B are arranged substantially above the first fixed chamber. The apertures of the movable chambers are thus arranged above the aperture of the fixed chamber. A fluid exit plane may be defined by the first and second apertures. Within the fluid exit plane, the first and second apertures are offset. It may further be seen that in this example, the width of the movable chambers is half the width of the fixed chamber. The total width over which fluid is supplied by the movable chamber thus substantially coincides with the width over which fluid is supplied by the static chamber. The positions of the movable chamber depicted in FIG. 1A may be regarded as the minimum width positions.

In FIG. 1B, the positions of the movable chamber are near a maximum width position. In these positions, there is substantially no overlap, or a minimum overlap between the aperture of the first fixed chamber 110 and the apertures of the movable chambers 120A and 120B. Effectively, the width over which fluid is supplied to the anilox roller is increased with respect to FIG. 1A, because of the changed position of the movable chambers. The fluid supply may thus be adapted to e.g. a changing width of a print medium. In FIG. 1A, the second and third chambers 120*a* and 120*b* are in their minimum width position, in which the apertures of the second and third chamber substantially completely overlap in the fluid exit plane with the first aperture.

Such a change in width of fluid supply is notably achieved in this example without moving any seals. Without such movable seals, the reliability of the fluid supply system may be improved and leakages reduced. Avoiding leakages of a fluid such as e.g. a primer fluid may improve life time and performance of a printing system in which such a primer fluid is used.

Figure 2:
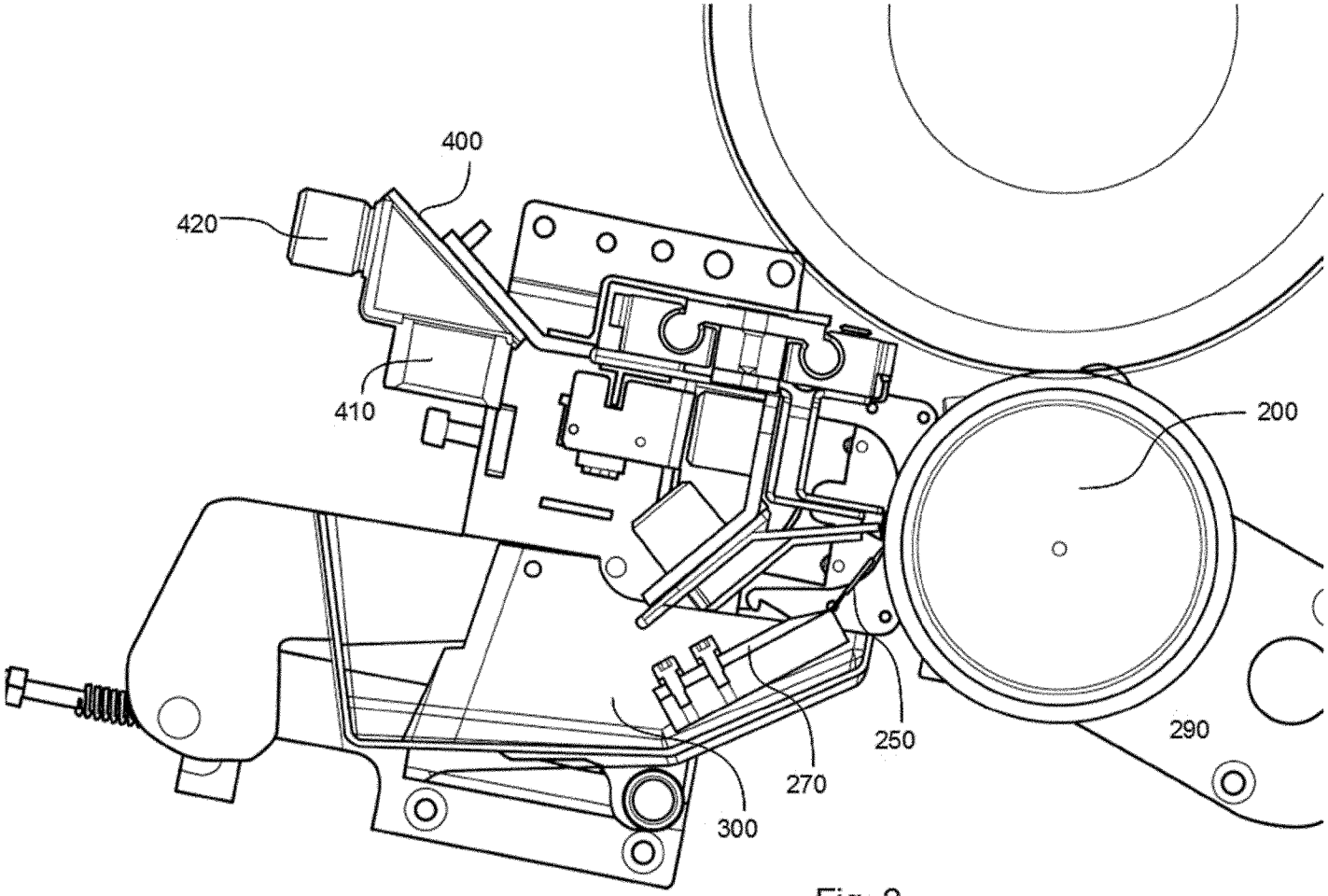
FIG. 2 is a schematic drawing showing a cross-section of a section of a printing system according to an example.

FIG. 2 is a schematic drawing showing a cross-section of a section of a printing system according to an example. In the example, the fluid supply system has the same or similar components as those described with reference to FIGS. 1A-1D. The same reference signs have thus been used.

Fluid may be supplied through a fluid inlet 410 to a manifold 400. From manifold 400 the fluid may be redistributed to the fixed chamber and movable chamber(s).

Fluid can thus be received in the fixed chamber and movable chambers in a similar manner as described before. From the pressurized chambers, the fluid is supplied through the corresponding apertures to the anilox roller 200. Anilox roller 200 in this example is mounted at an end of an anilox engage arm 290. With the engage arm 290, the position of the anilox roller 200 with respect to the applicator drum and the pressurized chambers can be controlled. From the applicator drum the fluid may be supplied to a print medium.

As illustrated before, any excess fluid on the anilox roller is removed by a doctor blade 250. And the fluid may thus be recirculated from collection tray 300 to inlet 410 of manifold 400.

Figure 3A:
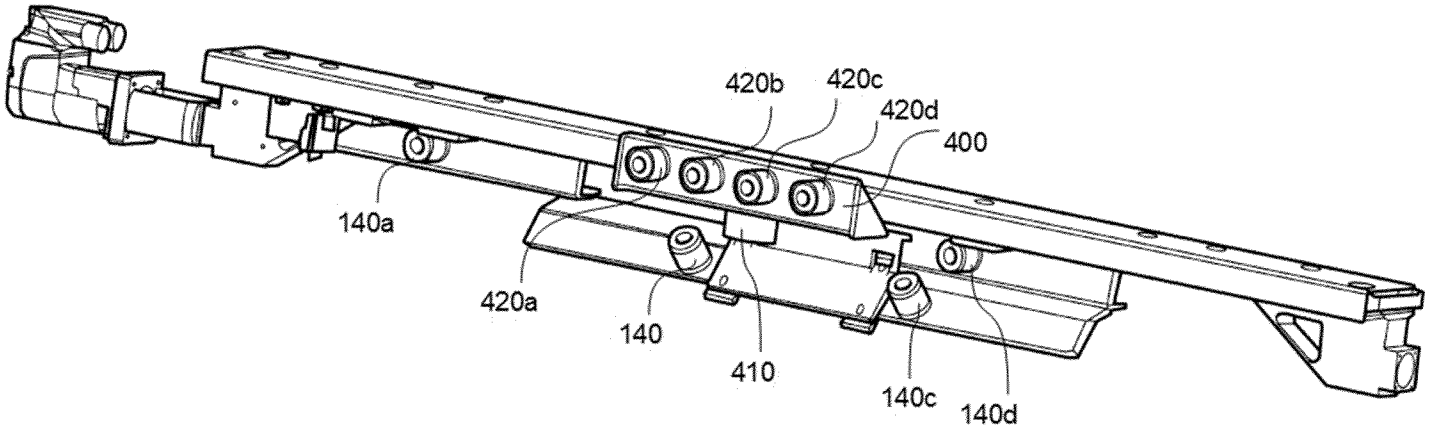
FIGS. 3A and 3B are schematic drawings of details of an apparatus for supplying a fluid according to an example.
Figure 3B:
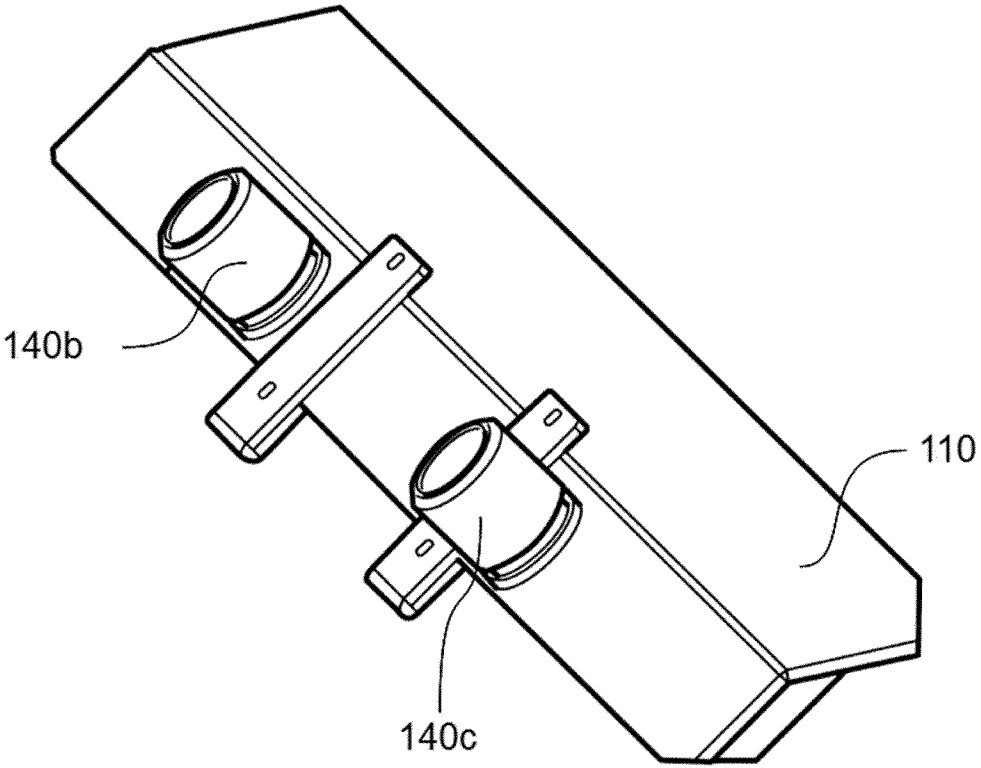

FIGS. 3*a* and 3*b* are schematic drawings of an apparatus applying a fluid to a transfer member according to an example. In this example, fluid supplied from inlet 410 to manifold 400 is divided into four equal flows through manifold outlets 420A, 420B, 420C and 420D. Each of these outlets is connected to an inlet of a pressurized chamber. In this case, four pressurized chambers are provided. Similarly as in the examples, before, a first fluid chamber is a fixed chamber having two fluid inlet nozzles 140B and 140C. A second and a third fluid chamber are provided which are movable. These chambers have fluid inlet nozzles 140A and 140D respectively. Flexible tubes may provide a fluid connection between the manifold outlets and inlet nozzles of the fluid chambers. The flexible tubes may be configured to adapt to the changing positions of the movable chambers.

In the specific examples, the fluid in the manifold is divided into flows with equal flow rates. The amount of fluid supplied to the first fixed fluid chambers is thus double the fluid supplied to the movable chambers. The width of the fixed chamber is also double the width of the movable chambers. The fluid flow per unit length may thus be the same. When the movable chambers are in the maximum width position to adapt for a wide format print medium, the fluid supply to the anilox roller may thus be substantially the same over the whole width. In order to ensure fluid supply over the whole width there may however be a minimum overlap between the fixed and movable chambers as described before with reference to FIG. 1. When the movable chambers are in the minimum width position, substantially double the flow per unit length is supplied to the anilox roller as compared to the flow per unit length with the movable chambers in the minimum width position. Any excess fluid however may be removed from the anilox roller by a doctor blade which may thus be arranged downstream with respect to the rolling direction of the anilox roller.

In other examples, other numbers of fluid supply nozzles 140 may be used, both in the fixed fluid chamber and in the movable chambers. The fluid supply nozzles may be spaced to allow uniform filling of the chambers with the fluid. An additional air evacuation aperture may also be provided for clogged air evacuation. In certain cases, a low pressure or vacuum may be applied to the air evacuation aperture to aid air outflow from the chamber and uniform fluid filing. Application of a low pressure or vacuum can also enable full filling of the chamber volume without fluid dripping from an aperture of the chamber.

Figure 4A:
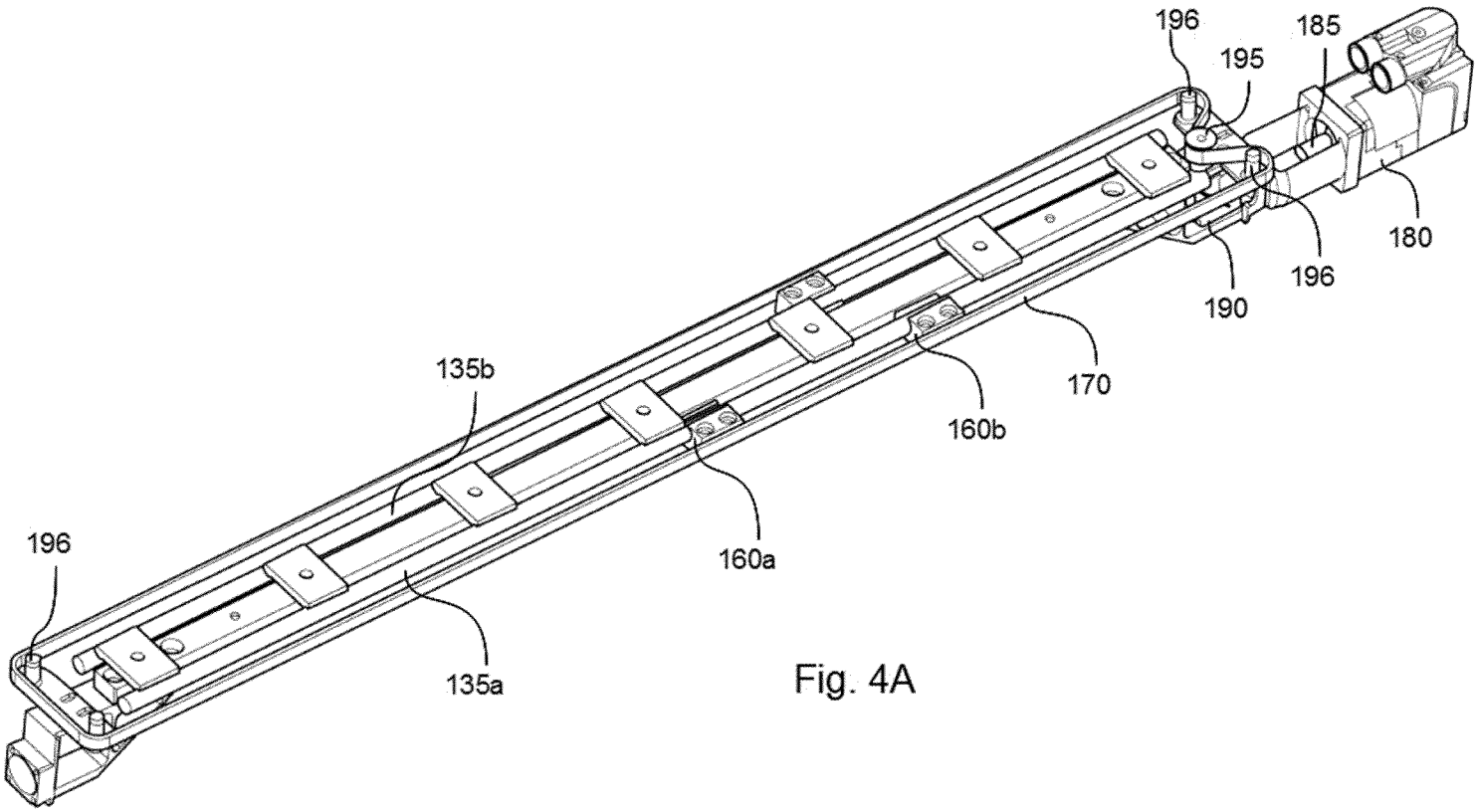
FIG. 4A is a schematic drawing showing a perspective view of a part of an apparatus for applying a fluid according to an example.
Figure 4B:
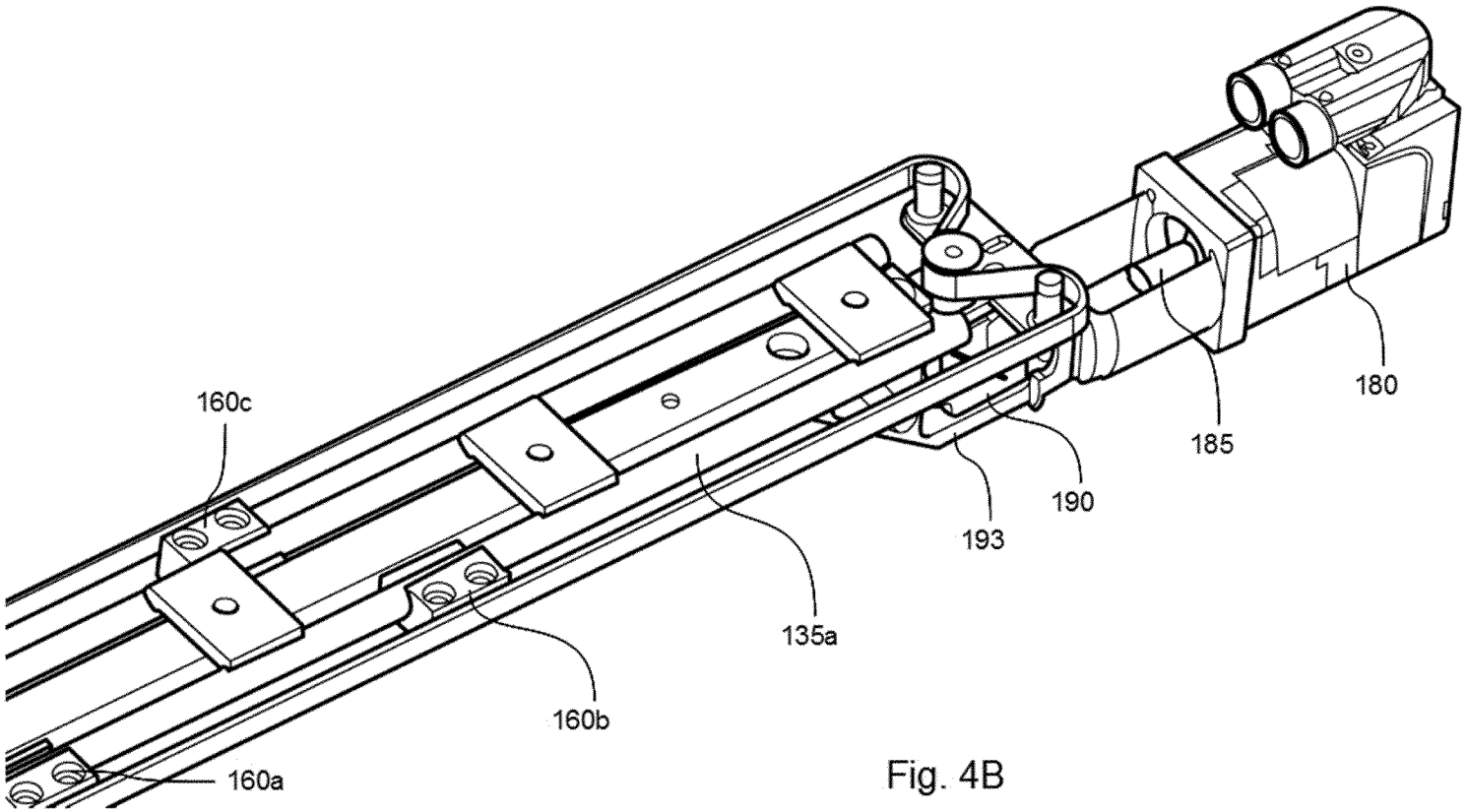
FIG. 4B is a schematic drawing of an enlarged view of a portion of the apparatus of FIG. 4B.
Figure 4C:
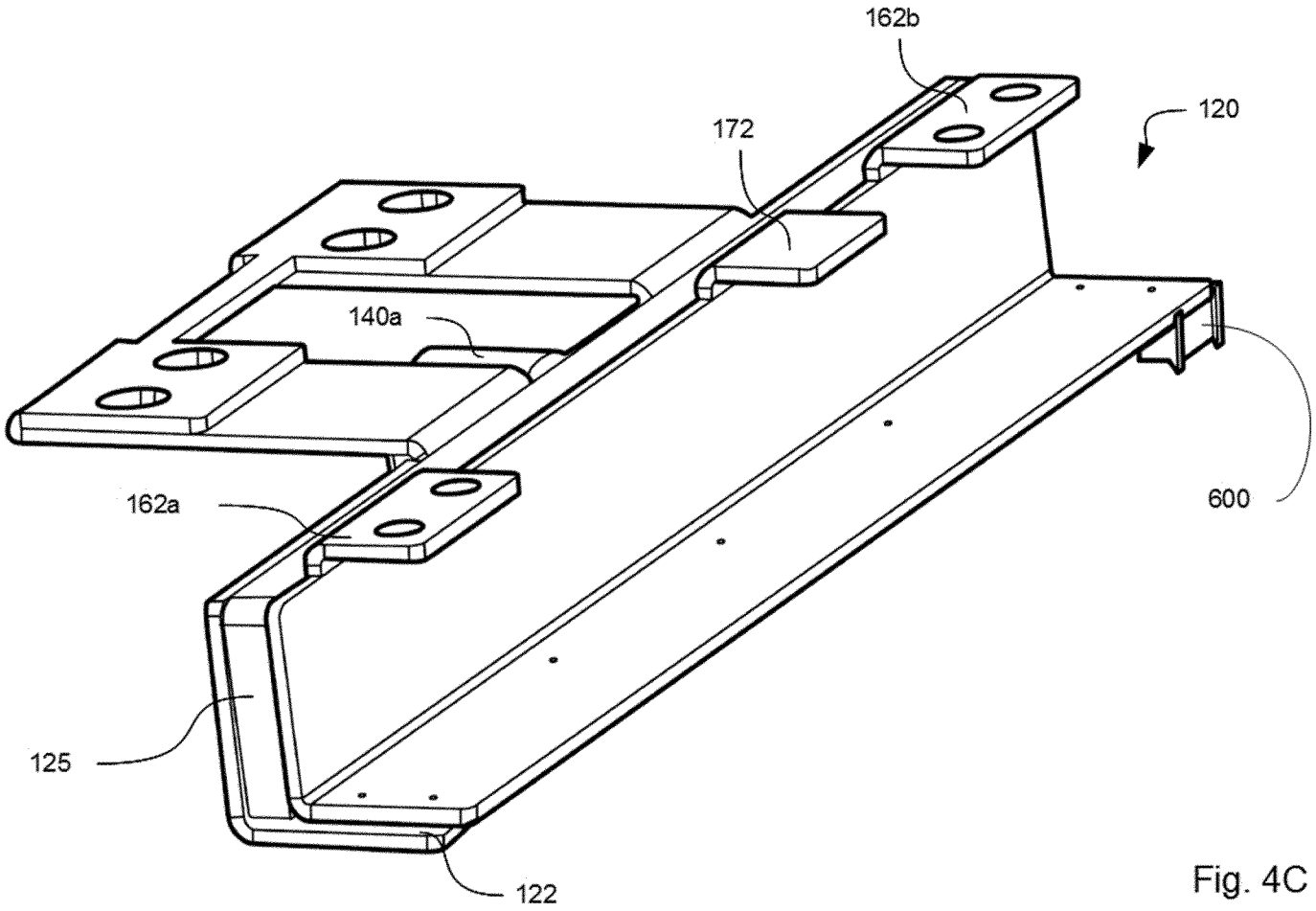
FIG. 4C is a schematic drawing of a perspective view of a component of an apparatus for applying a fluid according to an example.

FIG. 4*a* is a schematic drawing showing a perspective view of a part of an apparatus for applying a fluid according to an example. FIG. 4*b* shows an enlarged view of a portion of the figure and FIG. 4*c* is a schematic drawing of a perspective view of a movable fluid chamber that may be used in this example.

On the right hand side of FIG. 4*a*, a motor 180 is schematically shown. Motor 180 has an output shaft 185. The output shaft 185 of the motor 180 may form the input of a gear box or gear mechanism 190. In this example, a gearbox having perpendicular input and output shafts is shown. Such a gearbox arrangement may reduce the space needed for the drive mechanism.

The output of the gearbox 190 drives a pulley 195. An endless belt 170 may be driven by a driving pulley 195 and guided along additional idle rollers 196. Driving by the motor may thus result in the endless belt moving either in a clockwise or counterclockwise direction.

Also shown in FIGS. 4A and 4B are guiding bars 135A and 135B along which slide 127 may be guided. Each of the movable chambers may be connected to or attached to one of such slides to linearly move along guiding bars 135A and 135B. Each of the movable chambers may furthermore be attached to a portion of the endless belt. In this manner, if the motor drives the endless belt, the movable chambers may thus be linearly displaced, guided by bars 13A and 135B. One of the movable chambers may be attached to a portion of the endless belt that is in the front in the representation of FIG. 4A. The other movable chamber may be attached to a portion of the endless belt that is shown to be in the back of the representation of FIG. 4A.

With both movable chambers attached in this manner, the motor driving the endless belt will cause the movable chambers to move in unison. Furthermore it will cause the movable chambers to move linearly in opposite directions, since the front of the endless belt will move in opposite direction from the back of the endless belt.

In FIGS. 4A and 4B, mounting brackets 160A and 160B may be seen which in this example serve to connect the movable chamber to a slide 127 (not shown). Corresponding mounting brackets 162A and 162B are provided in the front wall of the movable chamber 120 shown in FIG. 4C. A further mounting bracket is extending from the rear wall of the movable chamber 120. This mounting bracket may be attached to mounting bracket 160C. A stable guiding along bars 135A and 135B may thus be provided.

Also shown in FIG. 4C is a mount 172 for attachment to the endless belt 170. The outer ends of the movable chambers may further comprise a format limiter 600 ensuring the sealing with the anilox roller at the edges. No fluid will thus extend beyond the edges.

The outer end of each of the movable chambers may comprise a format limiter, which serves to precisely define the width over which fluid is supplied. The format limiter 600 may be a Teflon® seal.

Figure 4D:
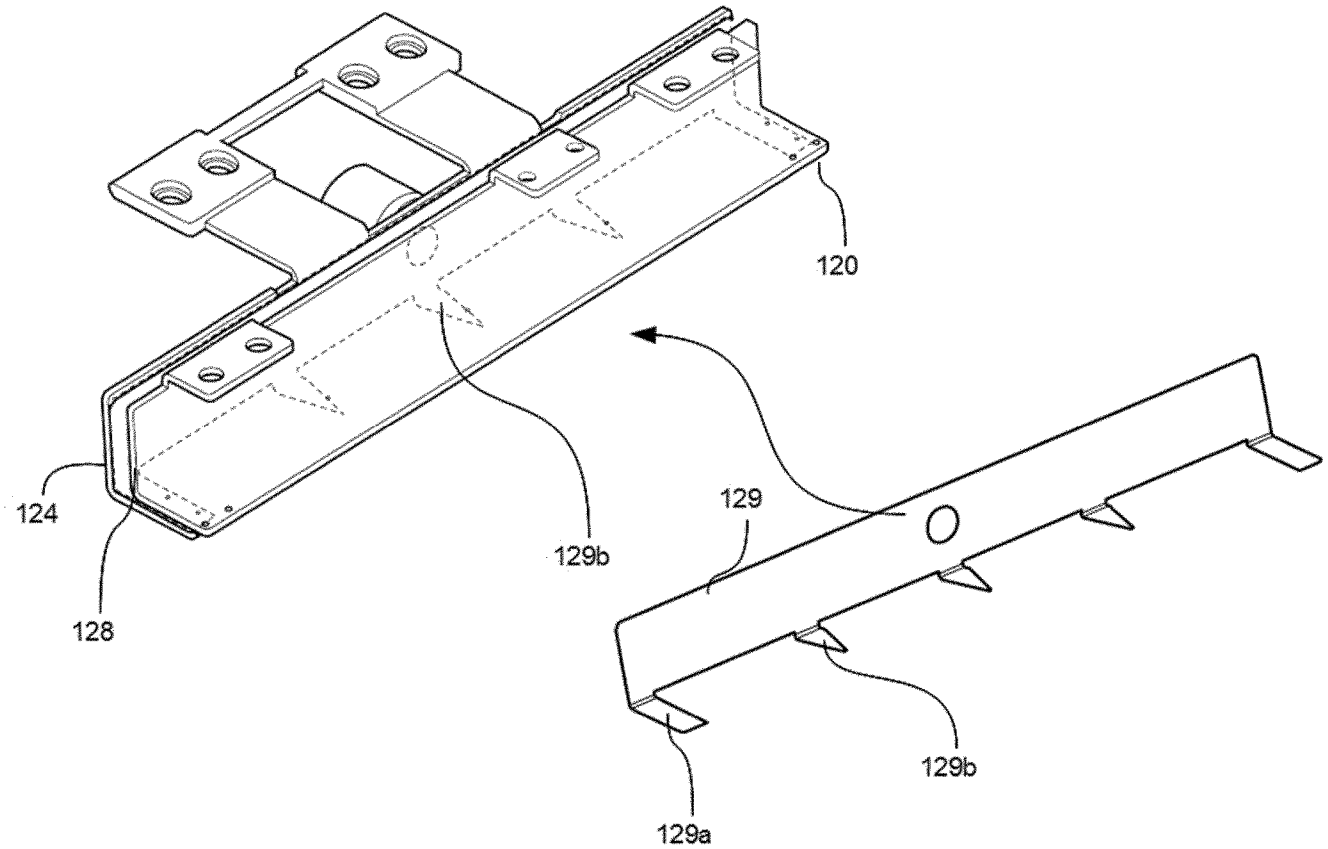
FIG. 4D is a schematic drawing of a perspective view of a build-up of the component shown in FIG. 4C.

FIG. 4D schematically illustrates further constructional details of the movable chamber 120 according to an example. A shim 129 may be attached to the rear bracket 124. The shim 129 in this example comprises projections 129*a* and 129*b*. The rear bracket 124 and front bracket may be fixed to each other, such that the shim is sandwiched in between the brackets. The shim 129 in this manner determines the height of the slit or aperture through which fluid can exit the chamber. Suitable sealing may be provided at the side edges of the movable chamber to avoid any leakage.

Fluid supply apparatus as disclosed herein may be incorporated in printing systems. In a general case, a printing system may comprise a transfer member that acts to transfer fluid from the chambers to a print medium or substrate or other print target. There may be one or more transfer members, e.g. a plurality of transfer members may be used to complete the transfer of fluid from the chamber to the substrate. In other cases there may be no transfer member, e.g. the fluid may be applied directly to a substrate via the previously described fixed and movable chambers.

In any case, transfer of the fluid within the chambers 110 and 120 to a substrate occurs. In one example, the fluid may comprise a primer, i.e. a priming solution, or a treatment liquid to be applied to the substrate before the deposit of ink. The transfer member may comprise an anilox roller, e.g. a cylinder upon a surface of which fluid is deposited, the fluid then being transferred to a substrate by way of rotation of the cylinder. In one case this is achieved using a further application roller (not shown) that receives fluid from the anilox roller and applies it to the application roller.

The combination of static and movable chambers allows fluid to be deposited onto areas of the anilox roller surface with varying widths. In turn, this allows efficient transfer of fluid to print media and substrates of various formats and/or sizes.

As dimensions of the print medium or print target vary, the width over which fluid is supplied can be adapted. In certain implementations, the dimensions of a print target may vary during a printing process, i.e. while printing. The width over which fluid may be supplied to the print target may thus be changed during the printing process. The fluid can thus be applied along the width of the print target, while not extending beyond its edges. A surplus of a fluid beyond these edges could damage other components of the printing system because of its aggressive nature, or by drying up and clogging certain components.

In certain implementations, aperture size is matched to fluid speed and anilox linear speed, i.e. the linear speed of the tangential surface of the anilox roller. The fluid speed in turn may be dependent on the anilox linear speed. In one case, the apparatus is configured such that fluid velocity is about half of the anilox linear velocity.

In one implementation, the anilox roller 250 may transfer fluid deposited on the surface thereon to a rubber application roller. In this case, the contactless arrangement may allow the anilox roller 250 to be disconnected from the application roller by way of a tangential movement, e.g. upwards or downwards. For example, the anilox roller 610 may be mounted on a pivoted arm that is moveable via a suitable actuator.

A disengagement movement may allow fluid transfer to the application roller to stop. This can control format length, e.g. the length of a cut substrate. Hence, in this case, control of print media with varying heights and widths is achievable. This allows fluid application off-roll, e.g. to a variety of cut substrates. For example, to prevent fluid from being applied to a substrate beyond the end of a cut length the anilox roller 250 may be displaced vertically in FIG. 2, such that at a subsequent time coincident with the end of the substrate passing the application roller, fluid would no longer pass to the application roller and thus the substrate. The control of anilox roller engage/disengage timing may be performed by a computer so as to match substrate length. Such control can be configured based on one or more of the geometry, timings and inertia ratio of the moving parts of the printing system.

A number of examples and variations are described above. It should be noted that certain described features may be extracted from the described examples and used independently to achieve an effect in a printing system. Moreover, omission, replacement and addition of features is envisaged. This may occur depending on particular factors of implementation.

In certain described examples, fluid format control is achieved, enabling control of fluid application to substrates that vary in width and/or length. Certain examples similarly provide efficient design features that enable fluid format control in a minimal time period and/or with minimal operator intervention. Certain examples and/or features described herein may reduce downtime in a printing system such as a printing press, reduce fluid contamination of surrounding areas and/or simplify maintenance. For example, the lack of contact with the anilox roller can reduce maintenance by avoiding significant wear.

Certain examples described herein are useful for sheet fed delivery techniques that can use, for example, liquid or primer application inside a substrate format. Substrate format could be any paper size in a given range; for example, in one case the apparatus may support a variable format width from 410 mm to 760 mm and a variable format length from 297 mm up to 535 mm. This is particularly useful for thin substrates, wherein an over wetting of substrate edges by a fluid can cause paper deformation. It is also useful for short print runs where it is useful to change primer application area with substrate format (e.g. width and length, i.e. values in a process dimension and a lateral dimension).

Certain examples described herein relate to apparatus and methods. In a method case, certain techniques described above may be applied, either using the described apparatus or another apparatus.

The preceding description has been presented only to illustrate and describe examples of the principles described. In certain Figures similar sets of reference numerals have been used to ease comparison of similar and/or comparative features. Variations are described herein, in places as features of examples. For example, the apparatus may be extended to a duplex system, any of the seals described herein including the piston and/or aperture seals may be constructed from Teflon® or a material with analogous properties. In a duplex system an arrangement comprising apparatus 100, anilox roller 250 and an application roller may be mirrored, with a first arrangement mounted above a media transport path and a second arrangement mounted below the media transport path, each arrangement being configured to apply a fluid to a respective side of a substrate. The term print medium or substrate may refer to a discrete medium, e.g. a page of paper or material, or a continuous medium, e.g. a roll of paper or vinyl. This description is not intended to be exhaustive or to limit these principles to any precise form disclosed. Many modifications and variations are possible in light of the above teaching.

What is claimed is:

1. An apparatus to apply a fluid in a printing system comprising:

a first chamber arranged to receive the fluid, the first chamber comprising a first housing, and a first elongate aperture extending along a first axis to discharge the fluid, a second chamber arranged to receive the fluid, the second chamber comprising a second housing, and a second elongate aperture extending parallel to the first axis to discharge the fluid, a third chamber arranged to receive the fluid, the third chamber comprising a third housing and a third elongate aperture extending parallel to the first axis to discharge the fluid, wherein the second and third chambers are movable laterally with respect to the first chamber to adjust a width over which the fluid is collectively applied by the apertures of the first, second and third chambers, wherein the second and third chambers are attached to an endless belt.

2. The apparatus according to claim 1, further comprising a linear guide, and wherein the second chamber is arranged to slide along the linear guide.

3. The apparatus according to claim 1, wherein the second chamber is arranged to be movable between a minimum width position and a maximum width position, wherein in the minimum width position, the second aperture substantially completely overlaps with the first aperture in a print medium transport direction.

4. The apparatus according to claim 3, wherein in the maximum width position the second aperture has a minimum overlap in the print medium transport direction with the first aperture.

5. The apparatus according to claim 1, wherein the second and third chambers are configured to move in opposite directions with respect to the first chamber.

6. The apparatus according to claim 5, wherein the second and third chambers are configured to move in unison.

7. The apparatus according to claim 1, wherein the second chamber is attached to a front portion of the endless belt and the third chamber is attached to a rear portion of the endless belt so that movement of the belt causes the second and third chambers to move in opposite directions.

8. The apparatus according to claim 1, wherein a length of the elongate aperture of the first chamber is twice that of the elongate aperture of the second and third chambers.

9. The apparatus according to claim 1, further comprising a manifold to provide four equal fluid flows to inlets of the first, second and third chambers, wherein the first chamber has two inlets and the second and third chambers each have one inlet.

10. The apparatus according to claim 1, further comprising a shim setting a size of the elongate aperture of the first chamber.

11. An apparatus to apply a fluid in a printing system comprising:

a first chamber arranged to receive the fluid, the first chamber comprising a first housing, and a first elongate aperture extending along a first axis to discharge the fluid, a second chamber arranged to receive the fluid, the second chamber comprising a second housing, and a second elongate aperture parallel to the first axis to discharge the fluid, a third chamber arranged to receive the fluid, the third chamber comprising a third housing and a third elongate aperture parallel to the first axis to discharge the fluid, wherein the second and third chambers are movable laterally in directions parallel with the first axis and with respect to the first chamber so as to adjust a width over which the fluid is collectively applied by the first, second and third chambers, wherein a length of the second and third apertures parallel to the first axis is substantially half a length of the first aperture along the first axis.

12. The apparatus according to claim 11, wherein the second and third chambers are attached to an endless belt.

13. The apparatus according to claim 12, wherein the second chamber is attached to a front portion of the endless belt and the third chamber is attached to a rear portion of the endless belt so that movement of the belt causes the second and third chambers to move in opposite directions.

14. A printing system comprising:

the apparatus according to claim 1, and further comprising a transfer member to transfer the fluid from the apparatus to a print medium, and wherein the transfer member comprises an anilox roller.

15. The printing system according to claim 14, wherein the fluid is a primer fluid.

16. The printing system according to claim 14, further comprising a doctor blade spaced from the first and second chambers in a direction of movement of the surface of the anilox roller.

* * * * *